US010159315B1

(12) United States Patent
Digiorgio

(10) Patent No.: US 10,159,315 B1
(45) Date of Patent: Dec. 25, 2018

(54) ILLUMINATED WALKING CANE

(71) Applicant: Joseph Digiorgio, Bayonne, NJ (US)

(72) Inventor: Joseph Digiorgio, Bayonne, NJ (US)

( * ) Notice: Subject to any disclaimer, the term of this patent is extended or adjusted under 35 U.S.C. 154(b) by 0 days.

(21) Appl. No.: 15/865,381

(22) Filed: Jan. 9, 2018

(51) Int. Cl.

| | |
|---|---|
| ***A45B 3/02*** | (2006.01) |
| ***A45B 3/04*** | (2006.01) |
| ***F21L 4/02*** | (2006.01) |
| ***F21V 23/04*** | (2006.01) |
| ***F21V 3/06*** | (2018.01) |
| ***F21V 31/00*** | (2006.01) |
| ***F21V 23/06*** | (2006.01) |
| *F21Y 115/10* | (2016.01) |

(52) U.S. Cl.
CPC ..... *A45B 3/04* (2013.01); *F21L 4/02* (2013.01); *F21V 3/062* (2018.02); *F21V 23/0407* (2013.01); *F21V 23/0414* (2013.01); *F21V 23/06* (2013.01); *F21V 31/00* (2013.01); *F21Y 2115/10* (2016.08)

(58) Field of Classification Search
CPC ..... A45B 3/02–3/04
USPC ..... 362/102
See application file for complete search history.

(56) References Cited

U.S. PATENT DOCUMENTS

| | | | | |
|---|---|---|---|---|
| 4,062,371 | A | 12/1977 | Bolen | |
| 5,361,793 | A * | 11/1994 | Stahnke | A45B 9/00 135/65 |
| 5,588,735 | A * | 12/1996 | Harada | A45B 3/00 135/910 |
| 5,810,466 | A | 9/1998 | Young | |
| 7,784,479 | B2 | 8/2010 | Navarro | |
| D698,140 | S | 1/2014 | Parker | |
| 8,985,802 | B2 | 3/2015 | Nievas | |
| 9,273,855 | B2 | 3/2016 | Dobie | |
| 2007/0151587 | A1 | 7/2007 | Yu | |
| 2010/0147342 | A1* | 6/2010 | Navarro | A45B 3/04 135/66 |
| 2010/0232175 | A1* | 9/2010 | Ho | B60Q 1/26 362/551 |

FOREIGN PATENT DOCUMENTS

| | | |
|---|---|---|
| WO | 2012083354 | 6/2012 |

* cited by examiner

*Primary Examiner* — Sean Gramling
(74) *Attorney, Agent, or Firm* — Kyle A. Fletcher, Esq.

(57) ABSTRACT

The illuminated walking cane comprises a shank, a finial, a plurality of LEDs, one or more batteries, and an on/off control. The walking stick may provide support to a user while walking or hiking. The plurality of LEDs covering the shank may provide illumination and increase visibility after dusk and at night. The plurality of LEDs are powered by the one or more batteries and are turned on or off using the on/off control which may be located on the finial at the top of the shank. The illuminated walking cane may further comprise a blinker circuit and a blinker control. The blinker circuit may interrupt the electrical circuit powering the plurality of LEDs in a repeating pattern, thus causing the plurality of LEDs to blink. Multiple blink patterns may be selected by activating the blinker control on the finial.

10 Claims, 3 Drawing Sheets

ILLUMINATED WALKING CANE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of walking sticks, more specifically, an illuminated walking cane.

SUMMARY OF INVENTION

The illuminated walking cane comprises a shank, a finial, a plurality of LEDs, one or more batteries, and an on/off control. The walking stick may provide support to a user while walking or hiking. The plurality of LEDs covering the shank may provide illumination and increase visibility after dusk and at night. The plurality of LEDs are powered by the one or more batteries and are turned on or off using the on/off control which may be located on the finial at the top of the shank. The illuminated walking cane may further comprise a blinker circuit and a blinker control. The blinker circuit may interrupt the electrical circuit powering the plurality of LEDs in a repeating pattern, thus causing the plurality of LEDs to blink. Multiple blink patterns may be selected by activating the blinker control on the finial.

An object of the invention is to provide a walking cane to support a user.

Another object of the invention is to provide illumination of the walking cane through the use of LEDs located on the surface of the walking cane.

A further object of the invention is to provide blinking patterns of the LEDs to increase visibility of the user.

Yet another object of the invention is to provide on/off and blink pattern controls on the final of the walking cane.

These together with additional objects, features and advantages of the illuminated walking cane will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated walking cane in detail, it is to be understood that the illuminated walking cane is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated walking cane.

It is therefore important that the claims be regarded as including such equivalent construction insofar as they do not depart from the spirit and scope of the illuminated walking cane. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
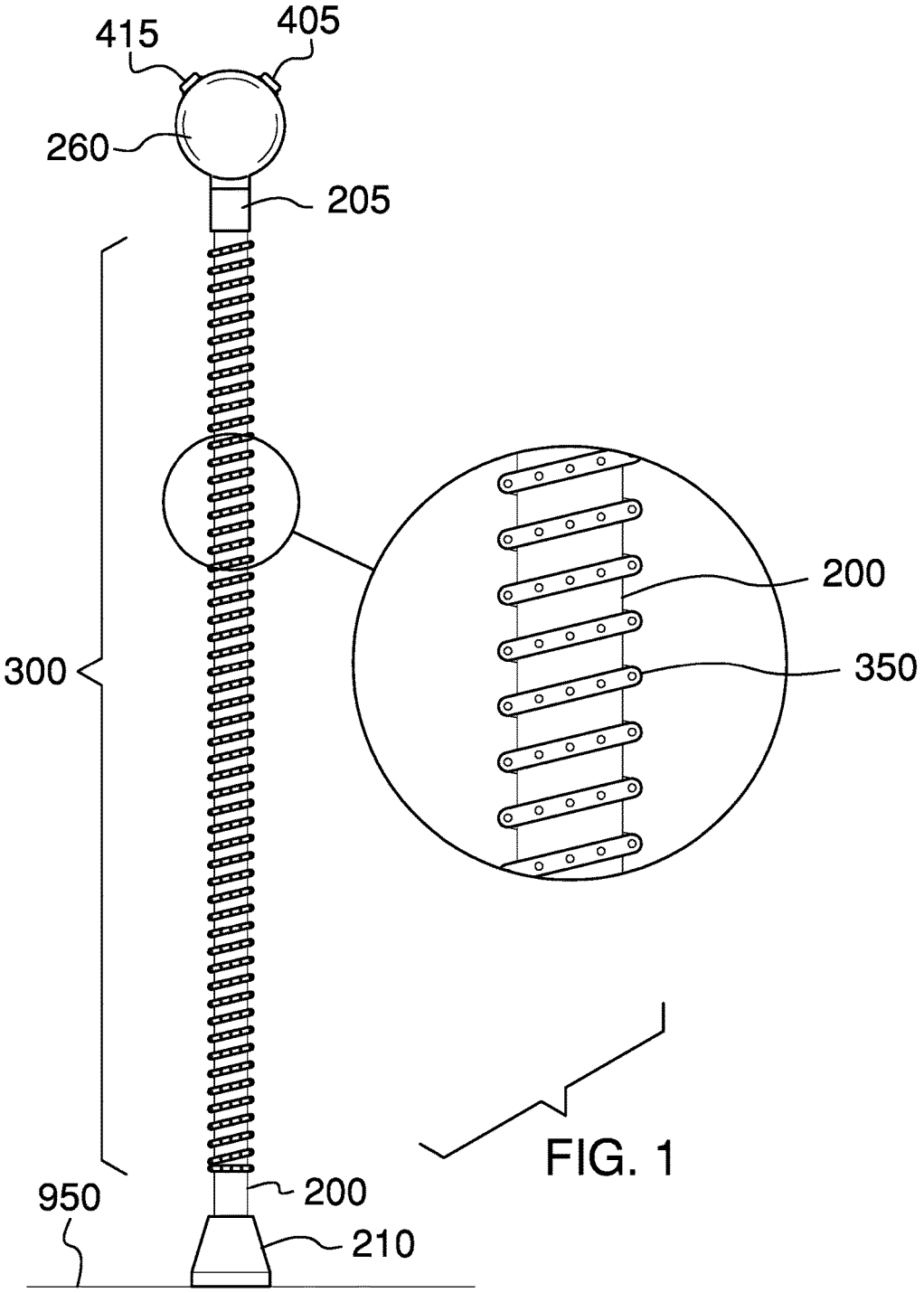
FIG. 1 is a front view of an embodiment of the disclosure.
Figure 2:
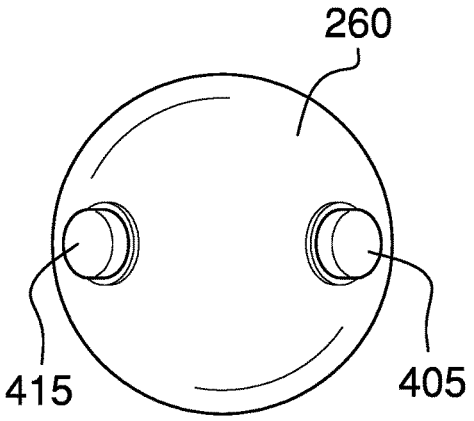
FIG. 2 is a top view of an embodiment of the disclosure.
Figure 3:
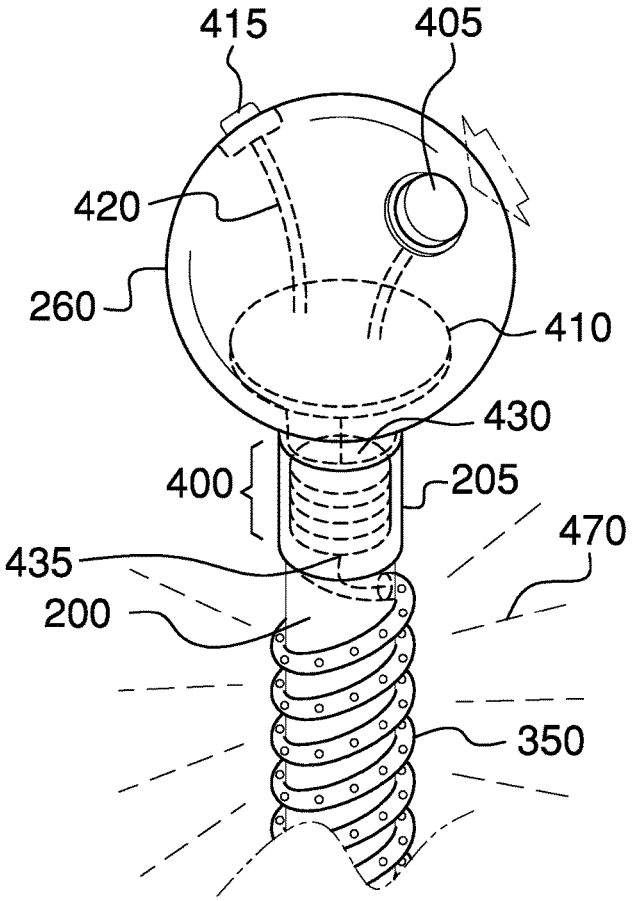
FIG. 3 is a detail view of an embodiment of the disclosure.
Figure 4:
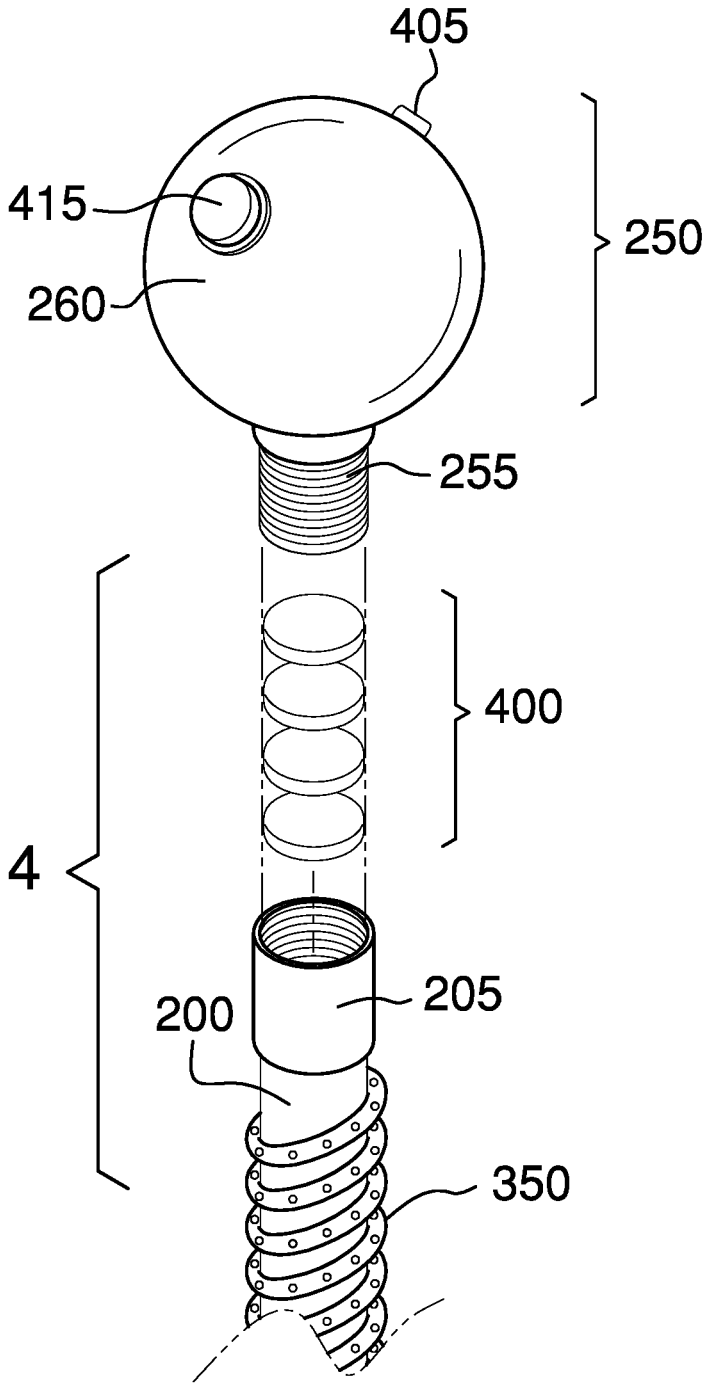
FIG. 4 is an exploded view of an embodiment of the disclosure.

Detailed reference will now be made to a first potential embodiment of the disclosure, which is illustrated in FIGS. 1 through 4.

The illuminated walking cane 100 (hereinafter invention) comprises a shank 200, a finial 250, a plurality of LEDs 300, one or more batteries 400, and an on/off control 405. The invention 100 is a walking stick, which is illuminated for improved visibility after dusk and at night. The invention 100 may reduce the risk of accidents while crossing a road at night. The invention 100 may provide illumination 470 for the path during night hikes.

The shank 200 may be a straight shaft composed of wood, metal or plastic. The shank 200 may have a length of between 3 ft and 5 ft. The top of the shank 200 may be coupled to a collar 205. The collar 205 may comprise a mechanical connection between the shank 200 and the finial 250. Specifically, the inside of the collar 205 on the shank 200 and the outside of a threaded nipple 255 on the finial 250 may be matching threads such that the threaded nipple 255 may screw into the collar 205.

The collar 205 may comprise an electrical connection between the plurality of LEDs 300 and the finial 250. The top of the shank 200 may house the one or more batteries 400. The bottom of the shank 200 may be coupled to a tip 210. The tip 210 may be a protective cap for the bottom of the shank 200. The tip 210 may protect the shank 200 from breaking due to contact with a walking surface 950. The tip 210 may also protect the walking surface 950 from being scratched by the shank 200.

The finial 250 comprises a ball 260 and the threaded nipple 255. The finial 250 may be a decorative adornment for the top of the shank 200. The on/off control 405 may be mounted on the finial 250.

The ball 260 may be a sphere comprising the uppermost portion of the finial 250. The ball 260 may be composed of wood, plastic, metal, or a combination thereof. In some embodiments, the ball 260 may be composed of clear acrylic. The on/off control 405 may be mounted on the ball 260 with wiring 420 running through the ball 260.

The threaded nipple 255 comprises the bottom of the finial 250. The threaded nipple 255 may mechanically coupled to the collar 205 on the shank 200 to hold the shank 200 and the finial 250 together. The threaded nipple 255 may electrically couple with the collar 205 to provide a return electrical path for electrical energy powering the plurality of LEDs 300.

The plurality of LEDs 300 may be applied to the outside surface of the shank 200. The plurality of LEDs 300 may be equally spaced over all or part of the shank 200. The plurality of LEDs 300 may be encapsulated in a clear plastic cover, coated with a clear material, of otherwise made waterproof. In some embodiments, the plurality of LEDs 300 may comprise an LED strip 350 wrapped around the shank 200 in a helical pattern.

The one or more batteries 400 may comprise one or more energy-storage devices. The one or more batteries 400 may be a source of electrical energy to operate the plurality of LEDs 300 and a blinker circuit 410. The one or more batteries 400 may be replaceable or rechargeable.

The one or more batteries 400 may be held in a battery compartment (not illustrated in the figures) located at the top of the shank 200. Electrical contact with the one or more batteries 400 may comprise a first battery contact 430 located at the bottom of the finial 250 and a second battery contact 435 located at the bottom of the battery compartment in the shank 200. The second battery contact 435 may be in contact with the top of the one or more batteries 400. The second battery contact 435 may be in contact with the bottom of the one or more batteries 400.

The on/off control 405 may be a control that is adapted to allow a user to illuminate the invention 100 or to extinguish the illumination 470. In some embodiments, the on/off control 405 may be a push button switch where each depression of the on/off control 405 toggles the on/off control 405 between a POWER ON position and a POWER OFF position.

In some embodiments, if the on/off control 405 is in the POWER ON position, electricity may flow from the top of the one or more batteries 400, through the first battery contact 430, through the wiring 420 to the on/off control 405, through the on/off control 405, through the wiring 420 to the threaded nipple 255, through the threaded nipple 255 into the collar 205, from the collar 205 through the wiring 420 to the plurality of LEDs 300, from the plurality of LEDs 300 through the wiring 420 to the second battery contact 435, and back into the one or more batteries 400 to complete the electrical circuit. As the electricity flows through the plurality of LEDs 300, the plurality of LEDs 300 are illuminated. If the on/off control 405 is in the POWER OFF position, the electrical circuit is interrupted at the on/off control 405 and the plurality of LEDs 300 will not be illuminated.

The blinker circuit 410 may be an electrical circuit that periodically interrupts the flow of electricity to the plurality of LEDs 300, thereby causing the plurality of LEDs 300 to blink. In some embodiments, the blinker circuit 410 may comprise two or more blink patterns that may be selected by repeatedly depressing a blinker control 415 until the desired blink pattern appears in the plurality of LEDs 300. In some embodiments, after a blinking pattern is established for the plurality of LEDs 300 a non-blinking pattern may be re-established by turning the invention 100 off and then on using the on/off control 405. In some embodiments, the non-blinking pattern may be re-established by cycling through the two or more blink patterns using the blinker control 415 until the non-blinking pattern appears in the plurality of LEDs 300.

To prepare the invention 100 for use, the one or more batteries 400 are installed by removing the finial 250, placing the one or more batteries 400 into the battery compartment at the top of the shank 200, and screwing the finial 250 back onto the collar 205 at the top of the shank 200. During daylight hours, the invention 100 may be used for support or aesthetic purposes. After dusk and at night, the on/off control 405 may be activated to illuminate the plurality of LEDs 300. When the plurality of LEDs 300 are illuminated, the invention 100 may illuminate the surroundings and may increase the ability of others to see the user. To make the user even more obvious to other pedestrians and motorists, the blinker control 415 may be activated to select one of the two or more blink patterns. When the illumination 470 is no longer needed, the on/off control 405 may be activated to remove power from the plurality of LEDs 300.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "ball" refers to an object with a spherical or nearly spherical shape.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts, which may not be illustrated in the figures.

As used in this disclosure, a "collar" is a ring like device that is placed around an object.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used herein, the word "desired" refers to a specific value within a range of supported values. A "desired" value indicates that a range of values is enabled by the invention and that a user of the invention may select a specific value within the supported range of values based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used herein, a "finial" is an ornamental termination for a rod, screw, staff, shank, post, peak, spire, pinnacle, or gable. A finial may be purely decorative or may be functional. As a non-limiting example, a finial may provide waterproofing or a housing for another object. Non-limiting examples of places where finials are used include curtain rods, lamp shades, walking canes, building roofs, furniture, fence posts, and staircase newel posts.

As used in this disclosure, a "helix" is the three dimensional structure that would is formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. "Helical" is an adjective which indicates that an object is shaped like a helix.

As used in this disclosure, an "LED" is an acronym for a light emitting diode. An LED allows current to flow in one direction and when current is flowing the LED emits photons. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

As used in this disclosure, the term "strip" describes a long and narrow object of uniform thickness that appears thin relative to the length of the object. "Strips" are often rectangular in shape.

As used in this disclosure, a "switch" is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

As used herein, the words "waterproof" or "watertight" refer to an object that is not harmed when being exposed to water, including total submersion for a period of time. When used as a verb, "waterproof" means to take steps to make an object waterproof. Non-limiting examples of such steps may include applying special coatings or using gaskets to seal seams and entry points of an enclosure.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An illuminated walking cane comprising:

a shank, a finial, a plurality of LEDs, one or more batteries, and an on/off control;

wherein the illuminated walking cane is a walking stick which is illuminated for improved visibility after dusk and at night;

wherein the shank is a straight shaft composed of wood, metal or plastic;

wherein the top of the shank is coupled to a collar;

wherein the collar comprises a mechanical connection between the shank and the finial;

wherein the inside of the collar on the shank and the outside of a threaded nipple on the finial are matching threads such that the threaded nipple screws into the collar;

wherein the collar comprises an electrical connection between the plurality of LEDs and the finial;

wherein the top of the shank houses the one or more batteries;

wherein the bottom of the shank is coupled to a tip;

wherein the tip is a protective cap for the bottom of the shank;

wherein the tip protects the shank from breaking due to contact with a walking surface;

wherein the tip protects the walking surface from being scratched by the shank;

wherein the finial comprising a ball and the threaded nipple;

wherein the finial is a decorative adornment for the top of the shank;

wherein the on/off control is mounted on the finial;

wherein the ball is a sphere comprising the uppermost portion of the finial;

wherein the ball is composed of wood, plastic, metal, or a combination thereof;

wherein the on/off control is mounted on the ball with wiring running through the ball;

wherein the threaded nipple comprises the bottom of the finial;

wherein the threaded nipple mechanically couples with the collar on the shank to hold the shank and the finial together;

wherein the threaded nipple electrically couples with the collar to provide a return electrical path for electrical energy powering the plurality of LEDs;

wherein the plurality of LEDs are applied to the outside surface of the shank;

wherein the plurality of LEDs are equally spaced over all or part of the shank;

wherein the plurality of LEDs are encapsulated in a clear plastic cover, coated with a clear material, of otherwise made waterproof;

wherein the plurality of LEDs comprises an LED strip wrapped around the shank in a helical pattern.

2. The illuminated walking cane according to claim 1 wherein the one or more batteries comprises one or more energy-storage devices;

wherein the one or more batteries are a source of electrical energy to operate the plurality of LEDs and a blinker circuit;

wherein the one or more batteries are replaceable or rechargeable.

3. The illuminated walking cane according to claim 2 wherein the one or more batteries are held in a battery compartment located at the top of the shank;

wherein electrical contact with the one or more batteries comprises a first battery contact located at the bottom of the finial and a second battery contact located at the bottom of the battery compartment in the shank;

wherein the second battery contact is in contact with the top of the one or more batteries;

wherein the second battery contact is in contact with the bottom of the one or more batteries.

4. The illuminated walking cane according to claim 3 wherein the on/off control is a control that is adapted to allow a user to illuminate the illuminated walking cane or to extinguish illumination.

5. The illuminated walking cane according to claim 4 wherein the on/off control is a push button switch where each depression of the on/off control toggles the on/off control between a POWER ON position and a POWER OFF position.

6. The illuminated walking cane according to claim 4 wherein if the on/off control is in the POWER ON position, electricity flows from the top of the one or more batteries, through the first battery contact, through the wiring to the on/off control, through the on/off control, through the wiring to the threaded nipple, through the threaded nipple into the collar, from the collar through the wiring to the plurality of LEDs, from the plurality of LEDs through the wiring to the second battery contact, and back into the one or more batteries to complete the electrical circuit;

wherein as the electricity flows through the plurality of LEDs, the plurality of LEDs are illuminated;

wherein if the on/off control is in the POWER OFF position, the electrical circuit is interrupted at the on/off control and the plurality of LEDs will not be illuminated.

7. The illuminated walking cane according to claim 6 wherein the blinker circuit is an electrical circuit that periodically interrupts the flow of electricity to the plurality of LEDs, thereby causing the plurality of LEDs to blink.

8. The illuminated walking cane according to claim 7 wherein the blinker circuit comprises two or more blink patterns that are selected by repeatedly depressing a blinker control until the desired blink pattern appears in the plurality of LEDs.

9. The illuminated walking cane according to claim 8 wherein after a blinking pattern is established for the plurality of LEDs, a non-blinking pattern is re-established by turning the illuminated walking cane off and then on using the on/off control.

10. The illuminated walking cane according to claim 9 wherein the non-blinking pattern is re-established by cycling through the two or more blink patterns using the blinker control until the non-blinking pattern appears in the plurality of LEDs.

* * * * *